US005921160A

United States Patent [19]

Yankaitis et al.

[11] Patent Number: 5,921,160

[45] Date of Patent: Jul. 13, 1999

[54] RELEASE ASSEMBLY FOR A WIRE CUTTING APPARATUS

[75] Inventors: Michael J. Yankaitis, Roscoe; Michael Kern, South Beloit, both of Ill.; Irvin Burns, Walloon Lake; Patrick Robbins, Petrosky, both of Mich.

[73] Assignee: Rockford Manufacturing Group, Inc., South Beloit, Ill.

[21] Appl. No.: 08/868,908

[22] Filed: Jun. 4, 1997

Related U.S. Application Data

[51] Int. Cl.[6] ..... B26D 5/28; B26D 5/40; B26D 7/06; B23D 25/00

[52] U.S. Cl. ..... 83/109; 83/210; 83/287; 83/290; 83/296; 83/360; 83/370; 83/150; 83/157; 83/950; 140/140

[58] Field of Search ..... 83/208, 210, 211, 83/212, 234, 360, 370, 372, 580, 214, 522.14, 649, 907, 950, 287, 290, 296, 363, 63, 86, 157, 162, 165, 209, 257, 361, 109, 150; 140/140

[56] References Cited

U.S. PATENT DOCUMENTS

| | | | |
|---|---|---|---|
| 507,101 | 10/1893 | Boggs | 140/14 |
| 1,259,968 | 3/1918 | Edwards | 83/296 |
| 1,714,480 | 5/1929 | Thacher | 83/580 X |
| 2,198,599 | 4/1940 | Borzym | 83/370 X |
| 2,310,914 | 2/1943 | Gaines et al. | 83/370 X |
| 2,325,431 | 7/1943 | Shippy | 83/363 X |
| 2,397,974 | 4/1946 | Morrow et al. | 83/208 X |
| 2,930,268 | 3/1960 | Neptune | 83/580 X |
| 3,031,908 | 5/1962 | Lejdegard | 83/580 X |
| 3,097,556 | 7/1963 | Mackey | 83/287 |
| 3,400,622 | 9/1968 | Olsen | 83/210 |
| 3,800,645 | 4/1974 | Alcock et al. | 83/287 X |
| 3,927,590 | 12/1975 | Gudmestad et al. | 83/151 |
| 5,570,728 | 11/1996 | Benedict et al. | 140/140 |
| 5,850,773 | 12/1998 | Burns | 83/950 X |

FOREIGN PATENT DOCUMENTS

| | | | |
|---|---|---|---|
| 582525 | 9/1959 | Canada | 83/208 |
| 2521654 | 11/1975 | Germany | 83/210 |
| 2732770 | 2/1979 | Germany | 83/950 |
| 506473 | 12/1976 | U.S.S.R. | 83/372 |

*Primary Examiner*—Rinaldi I. Rada
*Assistant Examiner*—Boyer Ashley
*Attorney, Agent, or Firm*—Leydig, Voit & Mayer, Ltd

[57] ABSTRACT

A release assembly for wire cutting apparatus. The present invention provides a release assembly for wire cutting apparatus which allows for dynamic alteration of the cut parameters. The release assembly allows for the length of the wire to be cut to be altered, allows for the biasing force to be increased or decreased to thereby reset the release assembly for a wide range of wire gauges, and allows for the stroke length to be altered to thereby either increase or decrease the cut frequency. The release assembly includes a housing having a distal end, a proximal end and a longitudinal chamber. A plunger tube is slidably disposed in the longitudinal chamber and is biased towards the proximal end by a dynamically adjustable spring mechanism. A gauge rod is mounted within the plunger tube at an adjustable axial position. In operation, the wire being pulled from the coil engages the gauge rod and pushes the gauge rod and plunger tube in the distal direction. A sensor senses the distal movement and sends a signal to the cutting mechanism to make a cut in the wire and drop the wire from the cutting machine. The plunger tube is retained in the housing by two collars. The distance between the two collars is dynamically adjustable during cutting operations to adjust the travel distance of the plunger tube. The position of the housing relative to the wire coils is also dynamically adjustable to control the cut length of the wire.

6 Claims, 3 Drawing Sheets

RELEASE ASSEMBLY FOR A WIRE CUTTING APPARATUS

FIELD OF THE INVENTION

The present invention generally relates to wire cutting apparatus, and more particularly relates to mechanisms for controlling the sequencing and timing of a wire cutting apparatus.

BACKGROUND OF THE INVENTION

Wire and cable are typically manufactured in the form of spools or coils of a predetermined number of lineal feet. Before the wire is used or even shipped to market, it is often necessary to cut the wire from the coil into shorter strips also of a predetermined linear length. In addition, in order to transform the wire from the curvilinear shape it assumes as a result of being coiled, an apparatus is often provided which straightens the wire and alleviates any radial forces tending to twist the wire. Straightened wire can then be supplied to a cutting apparatus to make the aforementioned strips of relatively short length.

In order to automate the cutting process, and to optimize the automated cutting process, it is necessary to provide a mechanism which provides the cutter with a signal to make each cut at the appropriate time. The cutter is often a blade which oscillates up and down to partially cut through the wire. A wiper blade is then provided to break the wire away from the stock. Such an operation is disclosed in pending U.S. patent application Ser. No. 08/627,935, assigned to the present assignee.

This sensing or release mechanism is often provided in the form of a movable member which abuts the leading edge of the wire being pulled from the feed coil and which is accordingly moved in a axial direction due to the force of the moving wire. This forces the member to pass a sensor which detects the movement and then sends a signal to the cutting mechanism to make the next cut. After each cut, a bracket holding the wire strip in place is released which allows the cut strip to drop due to gravity and be carried away for further processing. After each cut, the coil continues to feed wire to the cutting apparatus which again allows the wire to abut the movable member and pass the sensor to provide the next signal to the cutting apparatus.

Although such systems reliably provide signals to the cutting mechanism, they often provide a relatively unwielding apparatus when it is necessary to change any of the parameters of the given cut. For example, if the length of wire strip to be manufactured is to be changed, the only way to make this adjustment is to stop the feed roll, and adjust the position of the movable member within the release assembly. This requires the operator to release the clamping assembly holding the movable member in place, to move the member, and to retighten the clamp assembly. It is only after this substantial downtime period that operation of the feed roll can then begin again. Moreover, if the gauge of the wire cable being processed varies over time, the biasing mechanism for biasing the assembly back toward the feed roll after each cut to thereby reset the sensor, may not be sufficiently strong to force a heavy-gauge wire back toward the feed roll. The resulting strips cut from the machine will thereby be produced tending to have a longer than desired length.

In addition, the speed at which the cutting apparatus can make its cuts, is limited by the pace at which the release assembly is reset after each cut. This is in part dependent on the strength of the biasing mechanism, and is also dependent on the distance the movable member is required to travel before tripping the sensor. The longer the distance, the longer the time required for resetting the release assembly. Since time is money, money is necessarily lost if the reset time is not minimized.

SUMMARY OF THE INVENTION

It is the primary aim of the present invention to provide a release mechanism for a wire cutting apparatus which allows for easy, dynamic adjustment of the cut parameters including length, biasing force, and cut frequency.

It is an objective of the present invention to provide a release assembly for a wire cutting apparatus which allows for accurate adjustment of the strip length produced to thereby improve the output of the machine.

It is another objective of the present invention to provide a release assembly for a wire cutting apparatus which maintains its accuracy over a range of wire and cable gauges and weights.

It is still another objective of the present invention to provide a release assembly for a wire cutting apparatus which allows the frequency with which the cuts are made to be adjusted and minimized.

It is a still further objective of the present invention to provide a release assembly for a wire cutting apparatus manufactured from a relatively small number of parts to thereby lower the overall cost of the assembly.

It is a feature of the present invention to provide a release assembly for a wire cutting apparatus which includes a housing mounted within a mounting brace and which is provided with an adjustment nut therebetween to allow axial translation between the housing and the mounting brace. Rotation of the adjustment nut in a counterclockwise or clockwise direction causes the housing, and thus the release assembly, to move toward or away the wire being pulled from the feed roll. The length of the resulting cut can thereby be adjusted either while the machine is stopped or while it is running.

It is another feature of the present invention to provide a release assembly for wire cutting apparatus which is comprised of a gauge rod mounted within a plunger tube which is movably mounted within a housing. The plunger tube is caused to move as the gauge rod is engaged by the wire from the feed roll. The plunger tube is provided with a reduced diameter section having a trailing edge which is constantly monitored by a proximity switch mounted to the housing. When the trailing edge passes the proximity switch, a signal is sent to the cutting assembly which then makes the next cut in the wire. A spring mounted within the housing and around the plunger tube cooperates with a plunger to then move the plunger tube back toward the feed roll to reset the release assembly.

It is still another feature of the current invention to provide a release assembly for a wire cutting apparatus which is provided with an adjustable collar mounted around the plunger tube at the end of the housing toward the feed roll to thereby limit the distance the plunger tube is allowed to move due to the advancing feed wire. The collar must allow the plunger tube to move a distance sufficient to trigger the proximity switch, but can be positioned to minimize this movement and thereby minimize the time required for resetting the release assembly.

It is yet another feature of the present invention to provide a release assembly for wire cutting apparatus wherein a threaded collar is mounted onto the plunger tube at the end of the plunger tube adjacent the feed coil and which cooperates with a plunger mounted within the housing to compress and or expand a biasing spring mounted within the housing. By rotating the adjustment collar in one of a clockwise or counterclockwise direction, the collar is axially translated along the plunger tube which in turn forces the plunger against the spring to thereby compress the spring and increase the biasing force of the assembly. Therefore, if a relatively heavy gauge wire is being processed, the collar can be positioned so as to sufficiently compress the spring to provide an adequate biasing force for return of the wire after each cut.

These and other aims, objectives, and features of the present invention will become more apparent from the following detailed description when taken in conjunction with the accompanying drawings.

Figure 1:
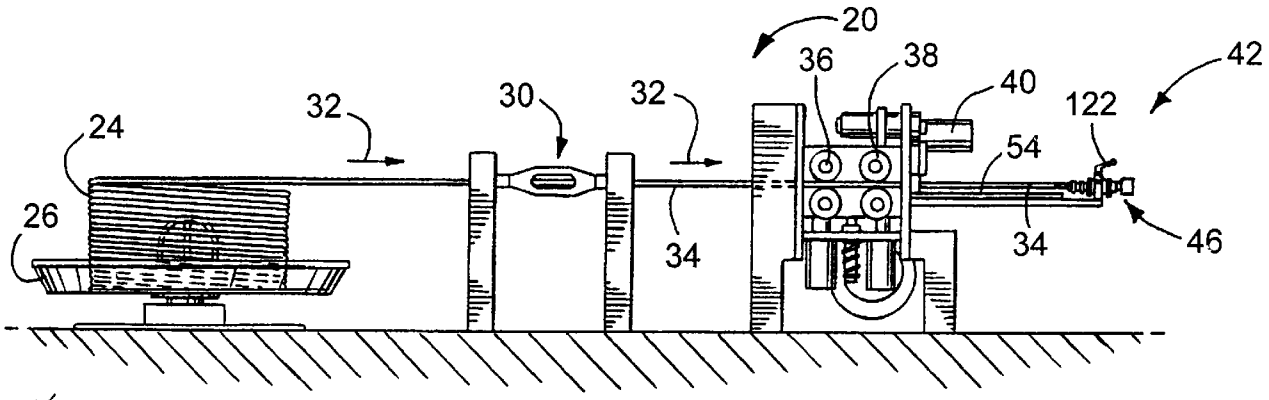
FIG. 1 is a schematic view of the entire wire cutting apparatus.

While the present invention is susceptible of various modifications and alternative constructions, certain illustrative embodiments thereof have been shown in the drawings and will be described below in detail. It should be understood, however, that there is no intention to limit the present invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

Referring now to FIG. 1, wire cutting apparatus 20 is shown positioned on a shop floor 22. As shown, a large diameter wire coil 24 is provided for rotation on turntable 26. A wire straightening apparatus 30 is then provided downstream of turntable 26 to straighten and untwist the wire or cable being fed from turntable 26. Proceeding in the direction of arrows 32, wire 34, then proceeds into two pairs of feed rolls 36 and 38, respectively, which rotate under compression to pull wire 34 from coil 24. A cutting mechanism 40 is provided downstream of feed rolls 36 and 38 to cut wire 34 at dynamically determined intervals as will be described in further detail herein.

Toward distal end 42 of wire cutting machine 20, the apparatus toward which the present invention is directed is shown. In order to provide a brief overview at this point, it is sufficient to state that, as wire 34 continues to proceed downstream in the direction of arrows 32, wire 34 eventually will engage gauge rod 44 which is mounted within release assembly 46. The motion of wire 34 against gauge rod 44 will cause plunger tube 48 to move in the distal direction within housing 50. A portion of plunger tube 48 which will be described in greater detail herein, is thereby caused to pass by a proximity switch 52 which is accordingly triggered to send a signal to cutting mechanism 40 to make the next cut. After each cut, trough 54 is released to allow the newly cut length of wire to drop due to gravity and for collection for further processing.

Figure 2:
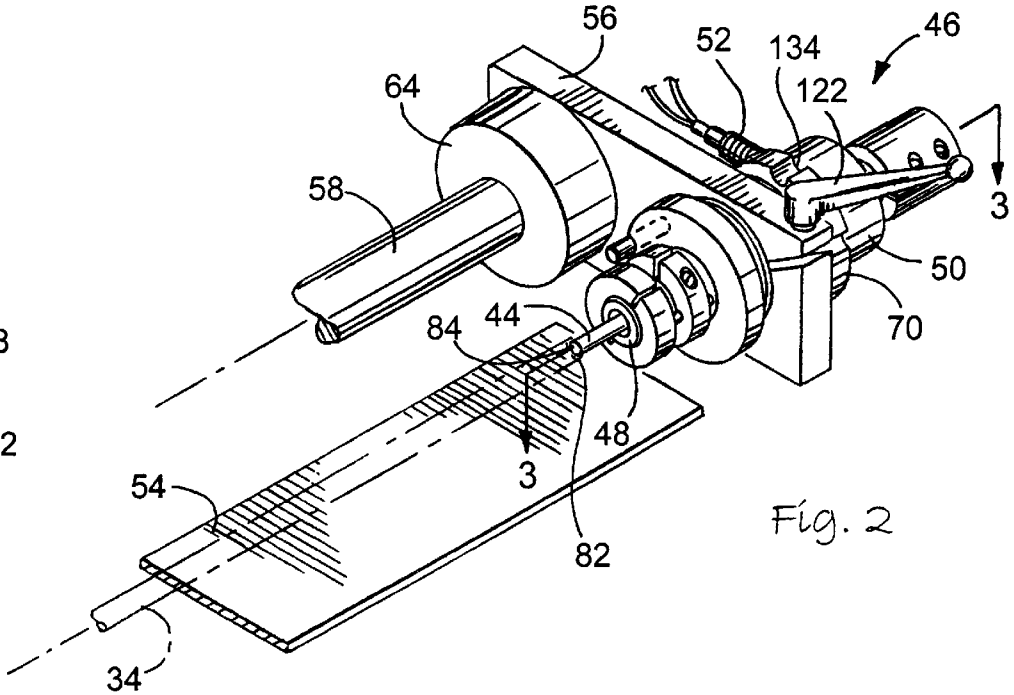
FIG. 2 is a perspective view of the release assembly.
Figure 6:
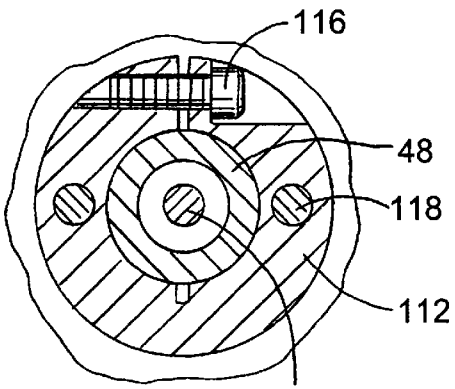
FIG. 6 is a sectional view of the plunger tube and the stroke-length adjusting collar shown in FIG. 3 taken along line 6—6.
Figure 7:
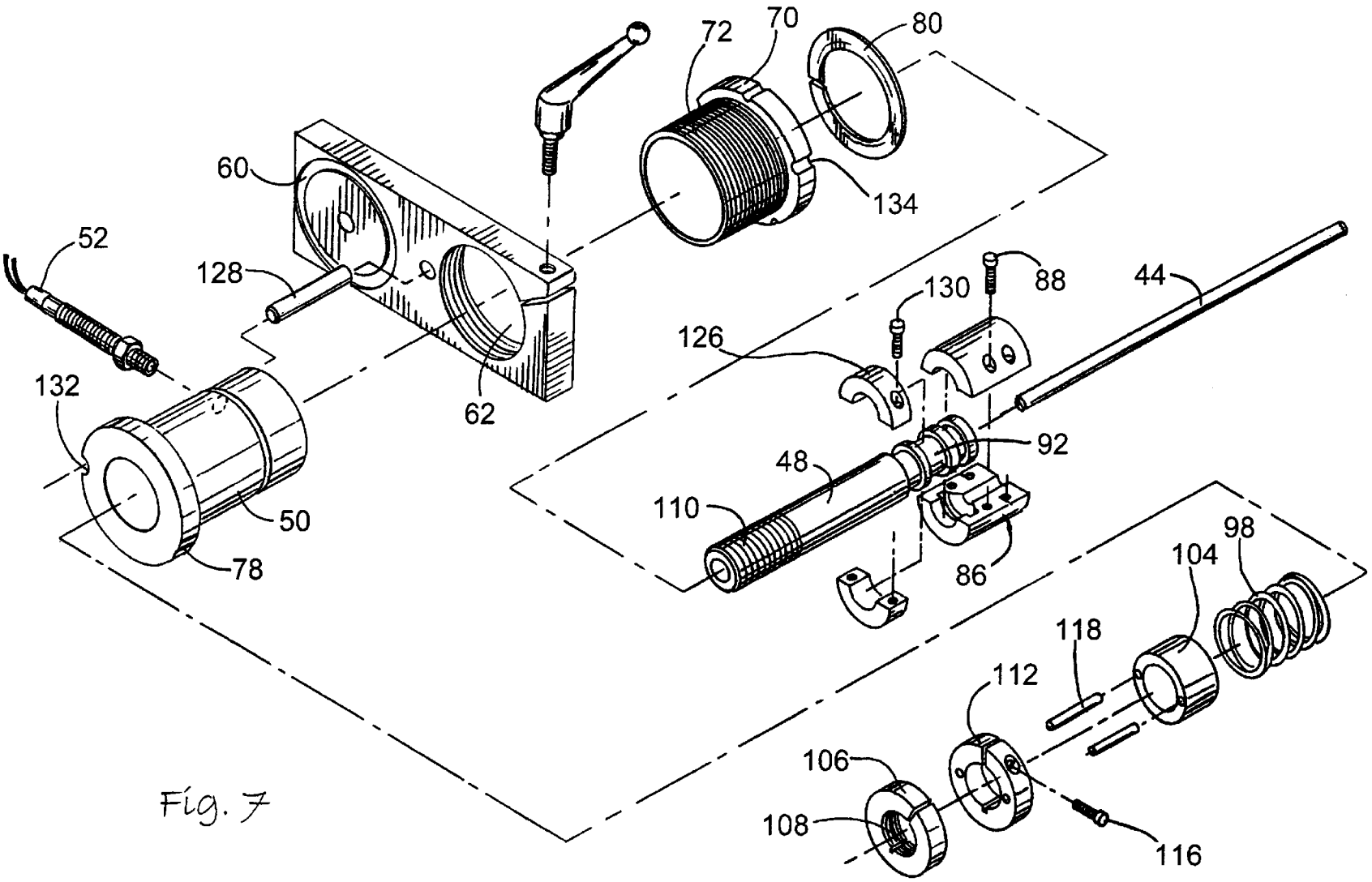
FIG. 7 is an exploded view of the preferred embodiment of the present invention.

The heart of the present invention, i.e., release assembly 46, is shown in greater detail in FIG. 2. As shown therein, release assembly 46 is mounted within a mounting base 56 which itself is fixedly attached to support frame 58 of wire cutting machine 20. As shown in FIG. 7, mounting base 56 has a substantially rectangular shape and is provided with upper recess 60 and lower aperture 62. Upper recess 60 is provided to receive spacer 64 which in turn is connected to support frame 58.

Figure 3:
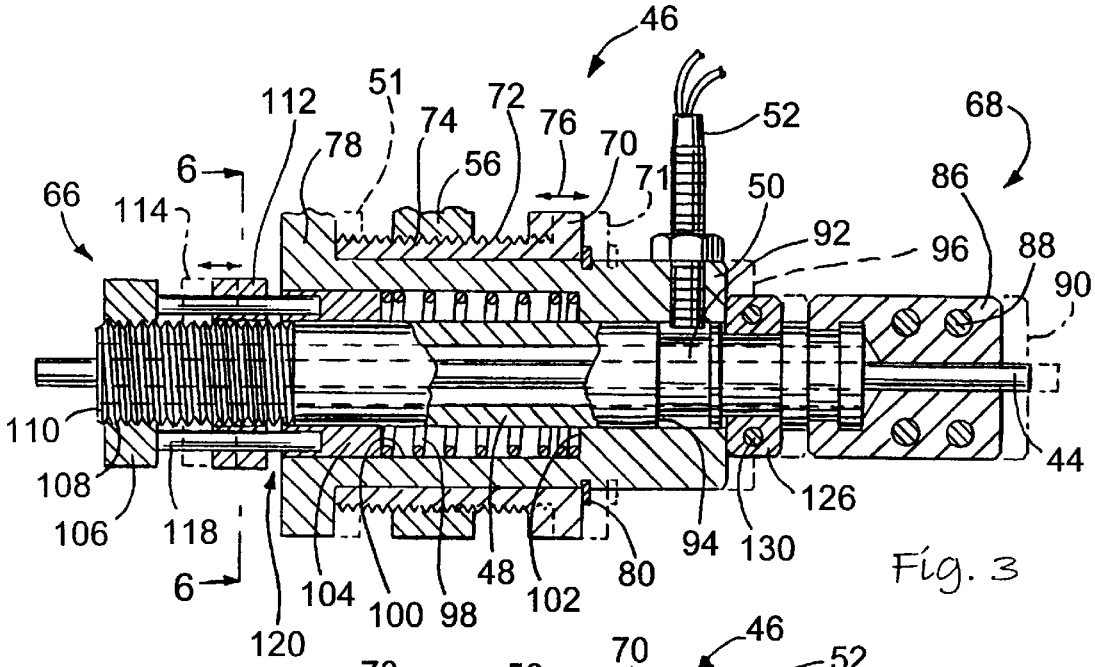
FIG. 3 is a sectional view of the release assembly shown in FIG. 2 taken along line 3—3, with the fine-adjustment nut and the stroke-length adjustment collar being shown in multiple positions.

Within lower aperture 62, housing 50 of release assembly 46 is movably mounted. Housing 50 is movable in an axial direction between proximal end 66 and distal end 68. As best shown in FIG. 3, this axial movement is accomplished through the cooperation of fine-adjustment nut 70 and lower aperture 62 of mounting base 56. Fine-adjustment nut 70 is provided with a plurality of external threads 72 which are matingly received by internal threads 74 of lower aperture 62. By rotating adjustment nut 70 in one of a counterclockwise or clockwise direction, nut 70 is caused to axially move in the direction of arrow 76 relative to mounting base 56. This in turn causes housing 50 to move in the same axial direction because nut 70 is journalled between proximal end flange 78 of housing 50 and distal annular ledge 80. The positions to which housing 50 and nut 70 can be moved are shown in phantom lines in FIG. 3 at 51 and 71, respectively.

Cylindrical key 128 is provided in mounting base 56 to engage keyway 132 of end flange 78 and thereby prevent rotation of housing 50 when nut 70 is rotated. One possible position to which nut 70 and housing 50 could be moved is shown in phantom lines in FIG. 3. For example, such a repositioning may be desirable if a longer length of wire is sought to be cut. In the preferred embodiment, nut 70 includes five gradations 134 which are provided to give the operator with an indication as to how far housing 50 has axially translated, and thus how much the length of each cut wire has been altered. In alternative embodiments a different number of gradations 134, or a different measurement system could be employed.

As shown in FIG. 2, wire 34 is provided with a leading edge 82 which engages proximal end 84 of gauge rod 44 as wire 34 advances downstream in the direction of arrows 32 (see FIG. 1). Gauge rod 44 is forced in the same direction which in turn forces plunger tube 48 in the same direction since gauge rod 44 is fixedly attached to plunger tube 48 by a clamp block 86. Clamp block 86 includes a plurality of set screws 88 to tighten clamp block 86 around gauge rod 44 and the distal end of plunger tube 48.

Figure 4:
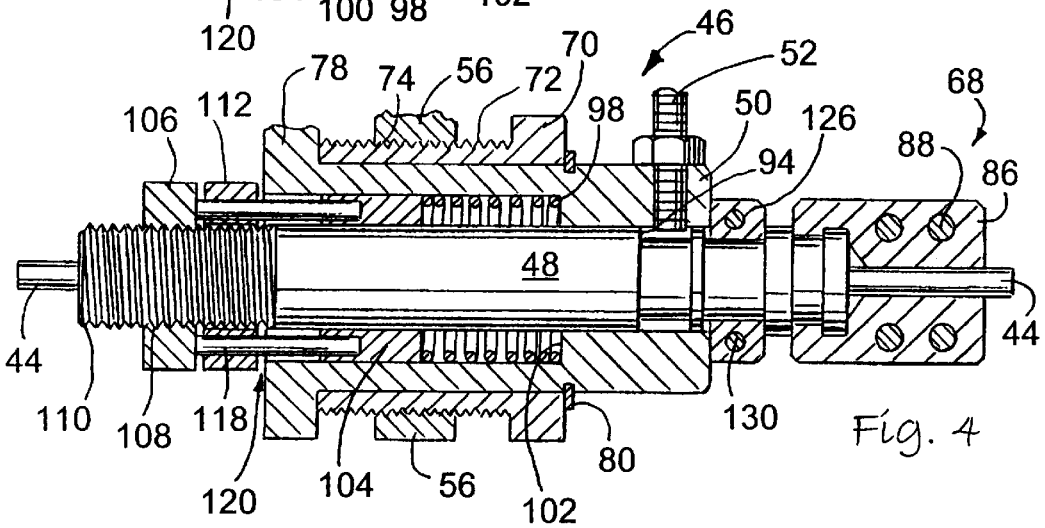
FIG. 4 is a sectional view of the release assembly of FIG. 2 taken along line 3—3, with the tension-adjusting collar being shown in a high tension position.
Figure 5:
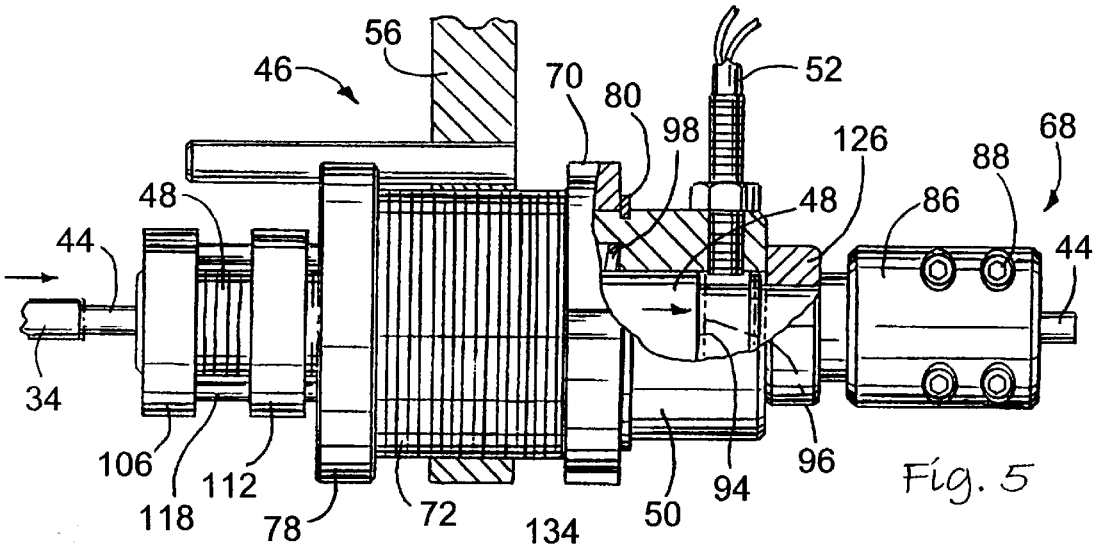
FIG. 5 is a partial sectional view of the release assembly showing the movement of the plunger tube and reduced diameter section thereof past the proximity switch.

One position to which gauge rod 44, plunger tube 48 and clamp block 86 might be moved downstream due to the movement of wire 34 in the direction of arrows 32 is shown in phantom lines in the area indicated generally by the reference number 90 in FIG. 3. The importance of this downstream movement is perhaps best understood by reference to FIG. 5. As shown in FIGS. 3, 4 and 5, plunger tube 48 includes a reduced diameter section 92 disposed toward the distal end of housing 50. Proximate reduced diameter section 92, proximity switch 52 is provided in housing 50. As opposed to prior art devices which employ relatively slow and cumbersome mechanical limit switches, the present invention provides the added ease and processing speed of a proximity switch. The downstream motion of plunger tube 48 causes trailing edge 94 of reduced diameter section 92 to pass by proximity switch 52 which in turn triggers proximity switch 52 to produce an output signal. The output signal is then communicated to cutting mechanism 40 to make the next cut. The position to which trailing edge 94 might be moved in a typical operation is shown in phantom lines at 96.

In order to reset release assembly 46, or in other words to move plunger rod 44, plunger tube 48, and clamp block 86 back toward its original position, a biasing force is provided in the form of spring 98 as shown in FIGS. 3 and 4. Spring 98 is of a conventional design and is disposed within longitudinal chamber 100 of housing 50. Longitudinal chamber 100 extends from proximal end 66 of housing 50 to inner annular landing 102 and is provided with a substantially greater diameter than the outer diameter of plunger tube 48. Spring 98 cooperates with inner landing 102 and plunger 104 to bias plunger rod 48 and gauge rod 44 in the proximal direction.

The degree of compression of spring 98 is controlled by the position of tension-adjusting collar 106 which is provided with a plurality of internal threads 108 which mate with a plurality of external threads 110 provided on the proximal end of plunger tube 48. Since tension-adjusting collar 106 is connected to plunger 104, rotation of tension-adjusting collar 106 in one of a clockwise or counterclockwise direction causes collar 106 and plunger 104 to move along plunger tube 48 in a distal direction. For example, in the position shown in FIG. 4, collar 106 has been axially advanced in the distal direction to compress spring 98 to a greater degree than that shown in the depiction in FIG. 3.

The practical importance of this feature is that, depending on the gauge of wire 34 being processed by machine 20, the biasing force required of spring 98 to reset assembly 46 will be variable. If the gauge of wire 34 being processed is particularly heavy, the spring 98 will necessarily have to be compressed a greater amount to force wire 34 backward to reset release assembly 46 after each cut. Similarly, if the gauge of wire 34 is relatively small or light, spring 98 can be compressed to the degree shown in FIG. 3. Otherwise, if spring 98 were compressed to the degree shown in FIG. 4, the spring would overcompensate and possibly cause the coil to buckle. Split collar 126 having set screw 130 is provided toward distal end 68 of plunger tube 48 to serve as a backup upon resetting assembly 46 and thereby prevents plunger tube 48 from moving too far in the distal direction.

One other inventive adjustment feature of the present invention is primarily accomplished through the provision of stroke-length adjusting collar 112. As shown in FIG. 3, stroke-length adjustment collar 112 is capable of being placed into a number of different positions with one position being shown in solid lines and another possible position being shown in phantom at 114 in FIG. 3. Stroke-length adjustment collar 112 is a conventional split collar having adjustment screw 116 (see FIG. 7). By loosening screw 116, collar 112 can be moved axially along guide pins 118 which connect plunger 104 to tension-adjustment collar 106.

The importance of stroke length adjustment collar 112 is that by positioning collar 112 either closer to, or farther away from, housing 50, and more particularly away from proximal end flange 78, the gap 120 therebetween is adjusted. It is the distance of gap 120 which dictates the length and thus duration of each stroke of machine 20. If it is desired for the length of the stroke to be relatively short, stroke-length adjustment 112 can be positioned approximately to the position shown in solid line in FIG. 3, which will only enable the stroke to travel the distance of gap 120 shown therein. This distance will be sufficient to allow proximity switch 52 to sense movement of trailing edge 94, but will minimize the length of the stroke to thereby allow the release assembly 46 to be reset quickly. This will therefore enable a higher frequency of cuts, and therefore a greater quantity of cuts to be made per unit of time. However, if it is desired for the stroke duration to be relatively long and therefore the process to be relatively slower, stroke-length adjustment collar 112 can be moved to the position shown in phantom lines at 114 in FIG. 3 to thereby widen gap 120. The length of the stroke would thereby correspond to the time it takes for stroke-length adjustment collar 112 to travel the distance of gap 120 and abut proximal end flange 78 of housing 50.

In operation, release assembly 46 will be mounted to wire cutting machine 20 via mounting base 56. As shown in FIG. 1, feed rolls 36 and 38 will pull wire 34 from coil 24 toward cutting mechanism 40 and ultimately will engage the leading edge of wire 34 with gauge rod 44. The force of this motion will cause gauge rod 44 to move in the distal direction which will in turn cause plunger tube 48 to move in the distal direction. As shown best in FIG. 5, this will cause trailing edge 94 of reduced diameter section 92 to pass by proximity switch 52 which in turn will sense this motion and send a signal to cutting mechanism 40 to make the next cut.

As this cutting operation is proceeding a number of modifications can be made on-the-fly. For example, if the length of each wire to be cut is to be adjusted for length, fine-adjustment nut 70 can be rotated either clockwise or counterclockwise to either lengthen or shorten each cut. The rotation of nut 70 will cause nut 70 to axially translate with respect to mounting base 56, which in turn will cause housing 50 to axially translate because nut 70 is journalled between proximal end flange 78 and distal annular ledge 80. By observing the location of gradations 134, the operator will be given an indication as to how far housing 50 has been moved, and thus how much the length of each cut wire has been altered. Crank 122 can then be tightened to lock fine adjustment collar 70 relative to base 56.

In addition, if it is desired to adjust the tension of spring 98 and thereby increase or decrease the biasing force to accommodate larger or smaller gauge wires, tension-adjusting collar 106 can be rotated clockwise and or counterclockwise. This rotation will in turn cause guide pins 118 and plunger 104 to rotate and axially translate with respect to housing 50. The motion of plunger 104 within longitudinal chamber 100 of housing 50 will in turn compress spring 98.

Moreover, if it is desired to adjust the length of each stroke of the machine, and thereby adjust for frequency of cuts, stroke-length adjustment collar 112 can be positioned axially along the threaded region of plunger tube 48 to either increase or decrease the distance of gap 120.

From the foregoing, it can be seen that the present invention brings to the art an improved release assembly for a wire cutting machine which allows for dynamic alteration of a number of the cut parameters. As opposed to prior art devices which require that the machine be stopped for the adjustment of wire length, adjustment of assembly tension for different wire gauges, and adjustment of stroke-length or cycle time, the present invention allows all three of these parameters to be adjusted while the machine is operating. This in turn produces a wire cutting machine which is more efficient, ultimately more accurate, and which has a greater throughput capacity.

What is claimed is:

1. A release assembly for a wire cutting machine operable in a cutting operation to pull wire from a wire coil to a cutting mechanism with the cutting mechanism cutting through the wire on command to make distinct lengths of wire, the release assembly comprising:

a housing having a distal end, a proximal end, and a longitudinal chamber between the distal and proximal ends, the proximal end being located closer to the wire coil than the distal end, a distance between the housing and the wire coil being dynamically adjustable during the cutting operation;

a plunger tube slidably disposed within the longitudinal chamber of the housing for reciprocation between the proximal and distal ends and having a longitudinal chamber;

means for biasing the plunger tube toward the proximal end, the means for biasing having a biasing force that is dynamically adjustable prior to, during and after the cutting operation, the means for biasing cooperating with a first collar and a second collar for retaining the plunger tube between the distal and proximal ends, respectively, to retain the plunger tube within the housing, the second collar being rotatable and axially translatable, wherein rotation of the second collar by an operator causes the second collar to axially translate relative to the first collar and adjusts the biasing force of the means for biasing;

a sensor mounted within the housing and adapted to sense a distal movement of the plunger tube towards the distal end and send a signal to the cutting mechanism when the distal movement is sensed; and a gauge rod mounted within the longitudinal chamber of the plunger tube, the wire being pulled from the coil engaging the gauge rod and pushing the gauge rod and the plunger tube toward the distal end during the cutting operation, the sensor sensing the distal movement and sending a signal to the cutting mechanism to make a cut in the wire and drop the cut wire from the wire cutting machine, an axial position of the gauge rod within the longitudinal chamber of the plunger tube being adjustable.

2. The release assembly of claim 1 wherein the housing has a cylindrical outer surface and a nut is mounted around the cylindrical outer surface and journalled between first and second raised ledges extending from the cylindrical outer surface, the nut having external threads adapted to mate with internal threads provided in a mounting base, rotation of the nut causing axial translation of the housing relative to the mounting base and the wire to thereby adjust the length of wire to be cut.

3. The release assembly of claim 1 wherein the sensor is a proximity switch and the plunger tube includes a reduced diameter section with a trailing edge, movement of the plunger tube causing movement of the trailing edge past the proximity switch to thereby generate the signal to the cutting mechanism.

4. The release assembly of claim 1 wherein the gauge rod extends through the plunger tube and is secured into position by a clamp block attached to the distal end of the plunger tube, the clamp block having a plurality of set screws which tighten the clamp block onto the gauge rod, the length of wire to be cut being adjustable by adjusting the axial position of the gauge rod within the clamp block.

5. A release assembly for a wire cutting machine of the type adapted to pull wire from a wire coil to a cutting mechanism with the cutting mechanism adapted to cut through the wire on command to make distinct lengths of wire, the release assembly comprising:

a housing having a distal end, a proximal end, and a longitudinal chamber between the distal and proximal ends, the proximal end being located closer to the wire coil than the distal end, a distance between the housing and the wire coil being dynamically adjustable;

a plunger tube slidably disposed within the housing longitudinal chamber of the housing for reciprocation between the proximal and distal ends and having a longitudinal chamber;

a spring mounted within the longitudinal chamber of the housing and around the plunger tube having a biasing force that is dynamically adjustable, the spring being journalled between an internal annular ledge within the housing and a plunger assembly threadably attached to the plunger tube in proximity to the proximal end, rotation of the plunger assembly causing the spring to depress and thereby causing the biasing force to increase, the spring cooperating with a first collar and a second collar for retaining the plunger tube between the distal and proximal ends, respectively, to retain the plunger tube within the housing, a distance between the second collar and the housing proximal end being dynamically adjustable;

a sensor mounted within the housing and adapted to sense a distal movement of the plunger tube towards the distal end and send a signal to the cutting mechanism when the distal movement is sensed; and a gauge rod mounted within the longitudinal chamber of the plunger tube, the wire being pulled from the coil adapted to engage the gauge rod and push the gauge rod and the plunger tube toward the distal end, the sensor sensing the distal movement and sending a signal to the cutting mechanism to make a cut in the wire and drop the cut wire from the wire cutting machine, an axial position of the gauge rod within the longitudinal chamber of the plunger tube being adjustable.

6. The release assembly of claim 5 wherein the plunger assembly includes a cylindrical plunger within the longitudinal chamber of the housing, an adjustment ring threadably attached to the plunger tube, and a pair of guide pins extending between the adjustment ring and the plunger tube, rotation of the adjustment ring causing axial movement of the plunger and compression of the spring, the second collar being a split collar attached to the guide pins, the distance between the split collar and the housing being adjustable by changing a position of the split collar along the guide pins.

* * * * *